United States Patent [19]

Lawrence et al.

[11] 4,208,085

[45] Jun. 17, 1980

[54] ASSEMBLED WEDGE RING FOR ELECTRICAL CONNECTORS

[75] Inventors: George J. Lawrence, North Kingstown; Herbert E. Kronsberg, Newport, both of R.I.

[73] Assignee: General Electric Company, New York, N.Y.

[21] Appl. No.: 891,378

[22] Filed: Mar. 29, 1978

[51] Int. Cl.[2] ..... H01R 13/58; D06N 7/00

[52] U.S. Cl. ..... 339/103 C; 339/139 C; 339/209; 428/100

[58] Field of Search ..... 339/103 C, 103 R, 139 C, 339/209; 24/16 PB; 428/100

[56] References Cited

U.S. PATENT DOCUMENTS

| | | | |
|---|---|---|---|
| 3,984,168 | 10/1976 | Korman | 330/103 C |
| 3,989,340 | 11/1976 | Sheldon et al. | 339/103C |
| 4,114,974 | 9/1978 | Lawrence | 339/103 C |

*Primary Examiner*—Roy Lake

*Assistant Examiner*—DeWalden W. Jones

*Attorney, Agent, or Firm*—Paul E. Rochford; Walter C. Bernkopf; Philip L. Schlamp

[57] ABSTRACT

An insulated cord clamp is provided for an electrical cap and for a connector. The cord clamp includes an inner collar and an outer collar which are mechanically linked to be moved axially relative to one another. The clamped cable or cord passes through the collars. A set of cleats or double wedges is joined by a flexible web and arranged in annular configuration within the collars to grip the cable. A set of ramps conforms to the set of double wedges with a first wedge of each double wedge disposed in each ramp. The outer collar has a beveled annular surface which operates as a continuous ramp on the second wedge of each double wedge of the set. The element constituting the set of double wedges and flexible web is formed flat. A double wedge is at one end of the element and has latching means for joining the other end thereto to give the element the annular form in which it is used.

3 Claims, 12 Drawing Figures

ASSEMBLED WEDGE RING FOR ELECTRICAL CONNECTORS

BACKGROUND OF THE INVENTION

The present invention relates to an electrical cap and connector device and particularly to the cable clamp portion of the cap and connector device. More specifically it relates to an insulating clamp for a cable which clamp forms part of an electrical clamp for a connector and to the elements of the cable clamp and the assembly of these elements for the clamping of a cable extending into the electrical cap or connector.

A prior art patent specifically the U.S. Pat. No. 3,989,340 assigned to the same assignee as the subject application describes an electrical cap and connector and more particularly the cable clamp portion of an electrical cap and connector and also describes the manner in which the elements of the cable clamp are assembled and brought together so that effective clamping of a cable extending into the cable clamp of the device may be accomplished and the cable may be firmly held within the electrical cap and connector.

It is well known of course that electrical caps and connectors are used for the temporary supply of electric power to mechanisms and machines and the like which need the electric power. To provide such temporary power supply a cap it connected to one end of a cable and a connector is fixed to the other end of the cable. Once the cap and connector are properly afixed and the cap can be inserted in a source of power supply. A connector can then be connected to an electric device, mechanism, machine or the like which can consume the power supplied through the cable.

It is also well known that cables should be supplied for such applications on the basis of the power needs of the device to be powered. This is done by forming a cable length of the proper kind to supply power at the proper rating and level to the device to use such power with out the inclusion of excess cable. In other words, most such applications involve the tailoring of a cable section to a particular power supply need and the attachment of cap and connector to the cable to render it useful for this purpose. These and many other aspects of the temporary supply of electricity will be understood and made known from review of the U.S. Pat. No. 3,989,340 referenced above as well as the number of other patents which are referred to and are included by number in the above patent. These include U.S. Pat. Nos. 3,461,417; 3,360,766; 3,461,417; 3,379,593; 3,437,980 all of which are referred to and described in the above U.S. Pat. No. 3,989,340 assigned to the same assignee as the present application. Also by way of prior art reference the U.S. Pat. Nos. 3,430,187; 3,865,461; 3,667,783; 3,624,591; 1,882,856; 1,181,451 of the United States are included in the reference patents in the above application. In addition British Pat. No. 165 issued in 1899 and British Pat. No. 876,293 and 905,455 in addition to German Pat. No. 1,489,532 are referred to in the prior art publication. Other patents are also included by reference in the 3,989,340 patent assigned to the same assignee as the subject application.

From the above reference patent it will be evident that a very useful and novel article is provided by the teaching of the prior U.S. Pat. No. 3,989,340 assigned to the same assignee as the subject application. It will also be realized that any modifications or improvements of the article will also be valuable inasmuch as the article itself which is the subject matter of the patent is of very considerable value for the purposes for which it was designed and constructed.

OBJECTS OF THE INVENTION

It is accordingly one object of the present invention to provide an insulating cable clamp which is fabricated with greater simplicity and assembled into an effective end use product.

Another object is to provide an article which can be manufactured in a flat strip form for self assembly into an annular form for use.

Another object is to provide an assemblable cord clamp capable of clamping cords of a wide range of sizes.

Another object is to provide an assemblable cord clamp which can be quickly assembled.

Other objects will be in part apparent and in part pointed out in the description which follows.

SUMMARY OF THE INVENTION

In one of its broader aspects objects of this invention can be achieved by providing a strip element of molded plastic material. The strip has an elongated flexible ribbon forming a main portion of the length thereof. The strip has formed as integral parts thereof cleats having double wedge configurations. The cleats extend laterally and one cleat is formed at the strip end with a latch receiving opening also integrally therein. At the opposite end of the strip a latch is formed integrally with the strip. By inserting the latch into the latch receiving cleat a mechanical linkage is formed between the two ends of the strip to put the strip into an annular form with the cleats disposed around the annular length thereof. The annular set of cleats is combined with two insulating collars to form a cord clamp. The cord clamp operates responsive to relative axial movement of the collars to cause an inward clamping movement of the cleats or to form an outward releasing movement of the cleats.

BRIEF DESCRIPTION OF THE FIGURES

The description of the invention which follows will be better understood by reference to the accompanying drawings in which.

DESCRIPTION OF THE PREFERRED EMBODIMENT

An improved cable clamp is provided according to the present invention as an improvement over the cable clamp taught in the U.S. Pat. No. 3,989,340 assigned to the same assignee as this application. The article of U.S. Pat. No. 3,989,340 is a cable clamp for an electrical connector as taught in the U.S. Pat. No. 3,461,417 which is also assigned to the same assignee as this application.

The electrical cap or connector has essentially two parts. The first part is the insulating body containing electrical contacts. This insulating body contains the means for terminating the conductors of an electrical cable extending into the connector so that the proper cables will be connected to the internal contacts thereof.

Figure 1:
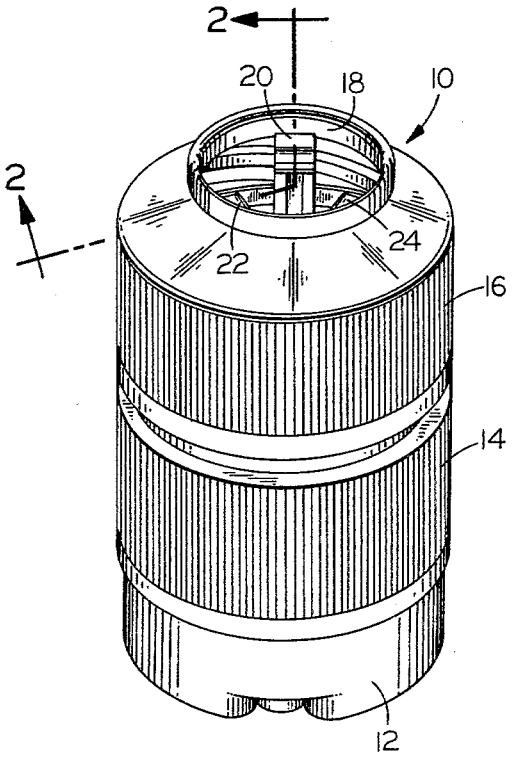
FIG. 1 is a perspective view of a connector illustrating the relation between the collars at the back of the connector and the electrical connector portion to which they are attached.

The second part of the connector is the clamp for the cable which passes through the cable clamp and is terminated in the insulating body described above. Referring first to FIG. 1 the cable termination body 12 is shown at the lower part of the connector 10. The cable termination part of the connector is not substantially different from that taught in the U.S. Pat. No. 3,461,417 and it is described in greater detail in the U.S. Pat. No. 3,989,340. It does not constitute part of this invention.

The upper part of the connector 10 is a cable clamp housing consisting of a lower collar part 14 and an upper collar part 16.

Figure 2:
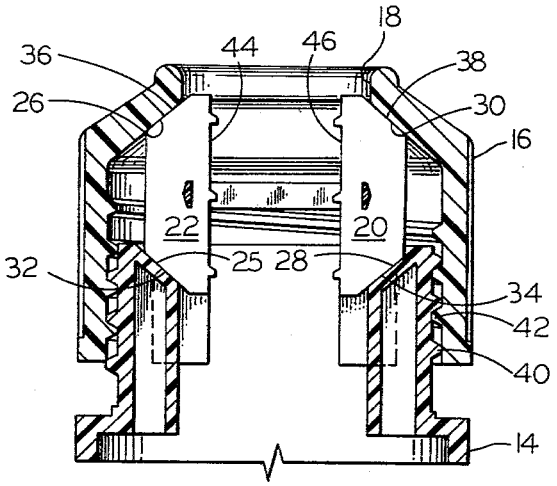
FIG. 2 is a partial vertical section taken along the angled line 2—2 of FIG. 1.

As illustrated in FIG. 1 the two housing parts 14 and 16 have essentially the same external diameter but as is evident from the cross-sectional view of FIG. 2 the upper housing collar has an internal thread and the lower housing collar has an internal thread and the lower housing collar 14 has an external thread which is threaded into the internal thread of upper part 16. The two housing parts 14 and 16 are essentially in the form of tubes or collars and the thread between the collars provides means for moving the two collars 14 and 16 axially thereof with respect to each other. At the top of FIG. 1 a cable entry opening 18 provides access for a cable extending through the two axially aligned collars to the cable termination body 12.

As also illustrated in FIG. 1 a number of cable gripping cleats 20, 22 and 24 are disposed in a symmetrical spaced pattern around the inner circumference of the opening 18. These cleats are made to move inward into a clamping position on a cable extending into and through the cable clamp portion of the connector by relative movement of the two collars 14 and 16 axially along the common axis. A movement of the collars 14 and 16 together causes the double wedge surfaces 25, 26 and 28–30, as viewed in FIG. 2, to be urged by the ramp surfaces 32 and 34 formed integrally with the inner surface of collar 14 and also the upper ramp surfaces 36 and 38 to operate on the upper wedge surfaces 26 and 30 to cause the inward movement of the double wedge cleats toward the center of the cable clamp. The axial movement of the collars 14 and 16 is induced by the rotary movement of one collar relative to the other and the inter-action of the threads 40 and 42 which are respectively on the outer threaded surface of collar 14 and on the inner threaded surface of collar 16. The actual gripping of the cable is accomplished as the inner surfaces 40 and 46 of the cleats 20 and 22 come into contact with the cable passing through the cable clamp.

Figure 3:
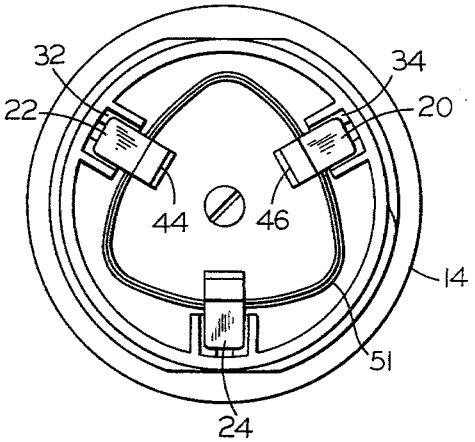
FIG. 3 is a top plan view of the device of FIG. 1 with the upper collar omitted to show the device interior.

The position of the cleats 20 and 22 relative to the ramp surfaces 32 and 34 is illustrated in FIG. 3. The cleats 22, 20 and 24 are connected as illustrated in FIG. 3 by a flexible band 5. The band is sufficiently self-supporting and supporting of the cleats so that the annular set of cleats may be positioned within the ramp surfaces of the collar 14 as a unit. The combination of the spaced cleats 20, 22 and 24 and the flexible band 5 is illustrated in free form in FIG. 4. The set of cleats in a connecting band functions very much in the manner in which the similar set of double wedges functions in the device described in U.S. Pat. No. 3,989,340 referred to above. Reference may be had to the patent for further details of its cable gripping action.

Figure 4:
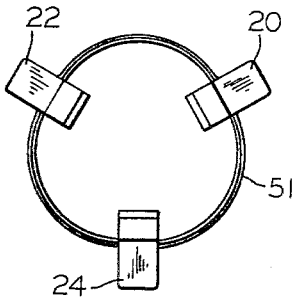
FIG. 4 is a top plan view of the annular band having the set of cleats formed integrally thereabout.
Figure 5:
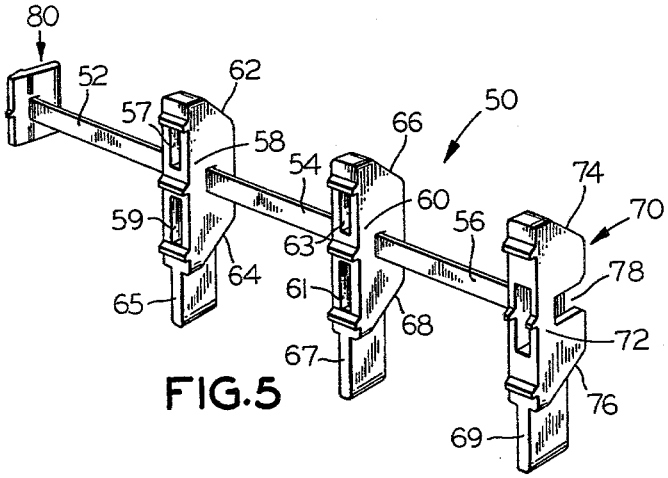
FIG. 5 is a perspective view of a strip element illustrating cleats having double wedge configuration integrally spaced along the length thereof.
Figure 10:
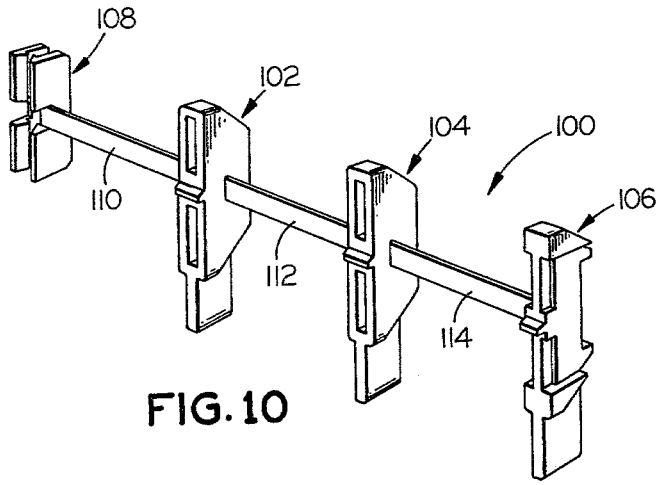
FIG. 10 is a perspective view of a strip element as illustrated in FIG. 5 but showing alternative form of latching components.

However, with regard to the subject application the novelty resides principally in the elongated element illustrated in FIGS. 5 and 10. Such novel element may be formed as a single elongated unit and which may nonetheless after such formation be assembled into the annular set of double wedges and gripping cleats which is described above with reference to the FIGS. 1 thru 4.

Referring now to FIG. 5, the elongated element 50 of this invention is seen to be made up in part of a flexible band having flexible band sections 52, 54 and 56. These band sections connect the two middle cleats 58 and 60 each of which has the double wedge surfaces 62, 64 and 66, 68. An end cleat 70 formed at the end of band section 56 has the cable gripping forward portion 72 and has the double wedge surfaces 74 and 76. It has in addition a latch receiving opening 78.

At the opposite end of element 50 the latching element 80 is formed integrally at one end of band section 52. In fact, the entire element 50 is formed integrally by molding as a single piece of plastic material. Materials such as nylon that may be employed in forming such an article so that the cleats 58, 60 and 70 will be firm and able to establish a firm grip on the cable by being wedged thereagainst and yet the connecting band 52, 54 and 56 will have sufficient pliability and springiness so that it will permit the assembly of the element into the form shown in FIGS. 4 and 3 and will also permit operation of the set of wedges within the cable clamp of this invention.

Figure 6:
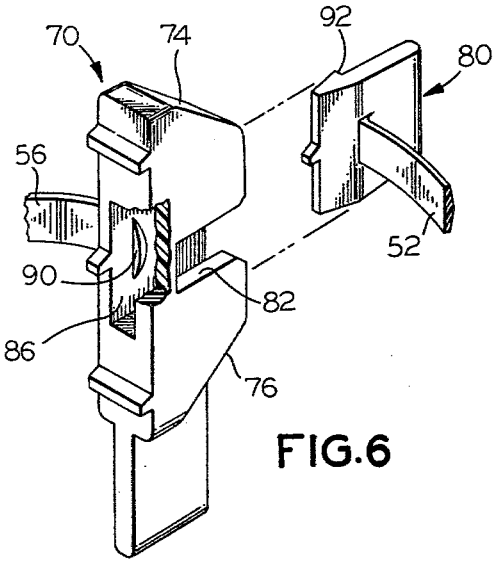
FIG. 6 is detailed perspective view of the latch receiving cleat and the latch in pre-assembled position.
Figure 7:
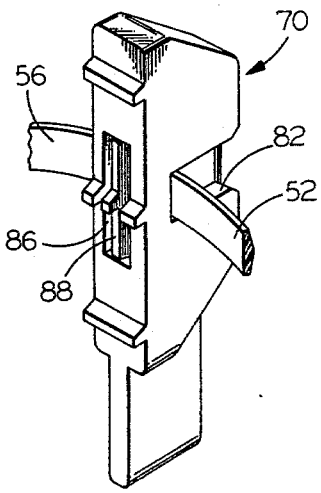
FIG. 7 is a view similar to that of FIG. 6 but showing the latching eomponents in their latched or assembled form.
Figure 8:
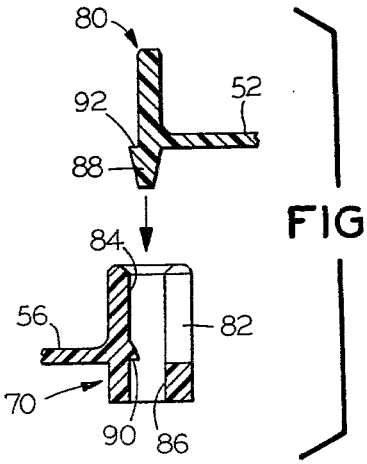
FIG. 8 is a horizontal sectional view of the latch receiving end cleat and latching component of the strip prior to assembly.

The assembly of the components of the element particularly the latching components is illustrated in FIGS. 6 and 7. The latching element 80 is brought all the way around through a 360° arc so that it becomes positioned directly behind the cleat 70. A side opening 82 in the cleat 70 admits the band portion 52 so that the latching element 80 may enter into the hollow rear opening in the rear of cleat 70. Therear opening 84 is best seen in FIG. 8. The front of this opening 86 receives the front portion 88 of the latch 80. As is illustrated in FIG. 6 the cleat 70 is provided with the side latching boss 90 and the latch element 80 is provided with a latch shoulder 92.

After the latch 80 has been inserted into cleat 70 and the latching boss 80 has been engaged by latch shoulder 92 the elongated article 50 has the form illustrated in FIGS. 4 and 3 of the drawing. So far as the cleat and latch itself are concerned, the form of the product is that illustrated in FIG. 7. In this figure it is evident that the band 52 extends from the opening 82 in the cleat 70 and that the forward surface 88 of the latch element 80 is seen through the front opening 86 in the cleat 70. The flexible band section 56 extends from the opposite side of cleat 70 and cleat 70 thus operates as one of a group or set of cleats extended symetrically about the annular arrangement of cleats as illustrated in FIGS. 4 and 3.

Figure 9:
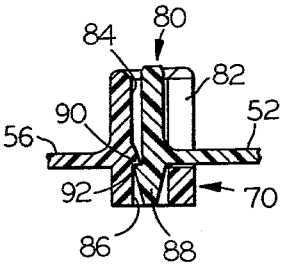
FIG. 9 is a view similar to that of FIG. 8 after the latching components are assembled.

The same arrangement of the elements described with reference to FIG. 7 is shown in sectional view in FIGS. 8 and 9. In fact, the elements of FIG. 9 are essentially the elements of FIG. 8 but shown in assembled form rather than in the preassembled form as they are illustrated in FIG. 8. In particular, the mating of the latching shoulder 92 with the latching boss 90 is illustrated clearly in the sectional views of FIGS. 8 and 9.

Figure 11:
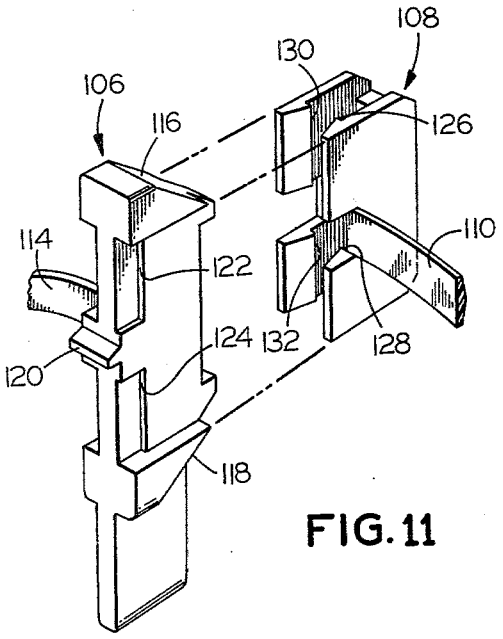
FIG. 11 is a perspective view of a latch receiving cleat and latch of the strip element illustrated in FIG. 10 disposed in pre-assembly position.
Figure 12:
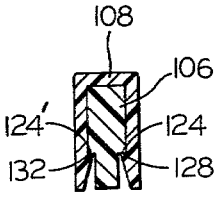
FIG. 12 is a sectional view of the assembled latching components illustrated in FIGS. 10 and 11.

Referring now to FIGS. 10, 11 and 12, an alternative form of the elongated strip element such as 50 described in FIGS. 5 thru 9 is illustrated. The strip itself 100 is made up of a set of three cleats 102, 104 and 106 which are joined by a flexible band made up of sections 110, 112 and 114. A major difference between the structure shown in the FIGS. 5 thru 9 and that of FIGS. 10 thru 12 is the latching mechanism. This difference will be readily evident from a comparison of FIGS. 6 and 11. With reference to FIG. 6 it is evident that the element 80, which is the latching element of the combination, inserts internally into the cleat 70. By contrast the latch 108 clamps externally on and about the exterior of the cleat body 106. The yieldable or flexible band sections 114 and 110 are formed integrally respectively with the cleat body 106 and the latch element 108. In fact, all elements of the strip 100 are formed in the single stroke of a molding press and all parts are accordingly formed integrally together. However, once the latch 108 is brought into latching position about the cleat body 106, the element 100 takes the form shown in FIGS. 4 and 3 and it serves in the manner described with reference the above specification as well as the U.S. Pat. No. 3,989,340 assigned to the assignee as the subject application and referred to above.

The cleat 106 has the two wedge surfaces 116 and 118, it has a cable gripping rib 120. It has two latch boss surfaces 122 and 124 on one side of the cleat, and two on the other side of the cleat, which mate with the latching shoulders 126 and 128 of the latch member 108. Similarly two latching shoulders 130 and 132 of latch element 108 mate with the conforming bosses on the far side of cleat 106. The bosses of latch element 108 are not illustrated in the perspective of FIG. 11, but are seen in the sectional view 12.

A sectional view of the assembled cleat and latch is illustrated in FIG. 12 where the inner cleat member 106 has formed integrally therein two latching shoulders 124 and 124[1]. Similarly the two matching surfaces 128 and 132 interlock with latching shoulders 124 and 132 respectively to provide the latching assembly of the cleat 106 to the latch element 108.

Based on the foregoing description it is readily evident that the present invention provides both a novel article for assembly into an annular set of cleats for cable clamping and a novel mechanism by which cable may be effectively, reliably and securely clamped at low cost.

Although the invention has been described with reference to certain specific embodiments thereof, numerous modifications are possible and it is desired to cover all modification filling within the spirit and scope of this invention.

Among the advantages which may be evident from the structure of the present invention are some which relate to the form of the product as this form relates to fabrication of the device. For example, the molding of the full round set of cleats as illustrated in U.S. Pat. No. 3,989,340 was gated through one of the cleats. Accordingly, a molded knit line had to be formed in the portion of the band opposite the cleat. Although fully operable parts were formed in most cases occasional failure of the molded article to be fully knit at the knit line did lead to some weakness of the flexible band in the area where the knit was formed. Occasional breakage occurred as well.

This weakness problem is overcome and corrected in the article of this invention as illustrated in FIG. 5, as no knit line is formed in the band or any other part of the article of FIG. 5.

A lighter set of cleats can be formed pursuant to this invention as is illustrated at 57, 59, 61 and 63 of FIG. 5. Such hollowing out does not reduce the effectiveness of the cleats in performing their wire gripping function. However, it does result in a more economical and superior product than that taught in U.S. Pat. No. 3,989,340.

Also, a problem of heating of the guides 65, 67 and 69 of the article of FIG. 5 is overcome in the structure formed as taught in this invention. The article is formed flat with the parting line of the mold along with length of the article. By contrast the article as taught in U.S. Pat. No. 3,989,340 had the parting line normal to the article as illustrated in FIG. 4 of this application as well as FIG. 4 of U.S. Pat. No. 3,989,340. Such overheating occurred due to compression of gas in the pocket of the mold in which guides such as 65, 67 and 69 were formed in the round. Such overheating did occasionally produce some discoloration of parts made of lighter color plastic. However, this problem is avoided in producing a part as illustrated in FIG. 5 of this application with a mold parting line extending in the plane in which the ribbon sectors 52, 54 and 56 lie.

What is claimed and sought to be protected by Letters Patent of the United States is:

1. A cord clamp for electrical connector comprising an inner insulating collar, said collar having internal spaced ramps,
   - a set of double wedge elements disposed in said ramps,
   - an outer insulating collar,
   - said collar having an internal beveled surface disposed for contact with the set of double wedge elements,
   - means for moving said inner collar axially relative to said outer collar to move said double wedge radially against a cable passing through said collars,
   - said set of double wedges being formed integrally with a yieldable connection web
   - said double wedges and inter-connection web being formed integrally and in the form of an elongated flat element
   - one end of said elongated element being an end double wedge adapted to receive a latching element and the other end of said element being a latching element adapted to inter-lock into said end double wedge to bring the web and set of double wedges into annular form.

2. The cord clamp of claim 1 in which the end double wedge has an opening to receive the latching element and the latching element is received in said opening.

3. The cord clamp of claim 1 in which the end double wedge has enternal latching bosses to receive a u-shaped latching element and the latching element is received about said end double wedge cleat.

* * * * *